US008875464B2

(12) United States Patent
Pervan et al.

(10) Patent No.: US 8,875,464 B2
(45) Date of Patent: Nov. 4, 2014

(54) BUILDING PANELS OF SOLID WOOD

(71) Applicant: Välinge Innovation AB, Viken (SE)

(72) Inventors: Darko Pervan, Viken (SE); Hans Brännström, Höganäs (SE)

(73) Assignee: Valinge Innovation AB, Viken (SE)

( * ) Notice: Subject to any disclaimer, the term of this patent is extended or adjusted under 35 U.S.C. 154(b) by 0 days.

(21) Appl. No.: 13/870,224

(22) Filed: Apr. 25, 2013

(65) Prior Publication Data

US 2013/0283720 A1 Oct. 31, 2013

Related U.S. Application Data

(60) Provisional application No. 61/638,747, filed on Apr. 26, 2012.

(51) Int. Cl.

| | |
|---|---|
| ***E04C 3/00*** | (2006.01) |
| ***E04F 13/08*** | (2006.01) |
| ***E04F 15/02*** | (2006.01) |
| ***E04F 15/04*** | (2006.01) |

(52) U.S. Cl.

CPC ..... *E04F 13/0894* (2013.01); *E04F 15/02038* (2013.01); *E04F 15/045* (2013.01); *E04F 2201/045* (2013.01); *E04F 2201/0161* (2013.01)

USPC ..... 52/578; 52/581

(58) Field of Classification Search

CPC ..... E04F 15/02; E04F 15/16; E04F 13/08

USPC ..... 52/578, 581, 588.1, 582.2, 592.2, 52/586.1, 586.2, 591.4; 403/381

See application file for complete search history.

(56) References Cited

U.S. PATENT DOCUMENTS

| | | | |
|---|---|---|---|
| 1,925,068 | A | 8/1933 | Gray |
| 1,995,264 | A | 3/1935 | Mason |

(Continued)

FOREIGN PATENT DOCUMENTS

| | | | |
|---|---|---|---|
| CA | 430631 | A | 10/1945 |
| CA | 2 463 192 | A1 | 10/2005 |

(Continued)

OTHER PUBLICATIONS

U.S. Appl. No. 13/932,406, Pervan.

(Continued)

*Primary Examiner* — Brian Glessner
*Assistant Examiner* — Paola Agudelo
(74) *Attorney, Agent, or Firm* — Buchanan Ingersoll & Rooney P.C.

(57) ABSTRACT

Building panels each comprise an upper first element of solid wood fixed to a lower second element of solid wood. The first and the lower second element are of different wood species. The building panels are provided with a mechanical locking system which comprises a locking strip at a first edge of a first building panel. The locking strip is provided with a locking element configured to cooperate with a locking groove at a second edge of a second building panel for horizontal locking of the first and the second building panels when a tension force is applied. The fiber direction of the first and the lower second elements is essentially along the first and the second edges. The lower second element has about the same or higher moisture shrinkage value than the first element. The locking strip comprises material of the lower second element.

21 Claims, 9 Drawing Sheets

(56) References Cited

U.S. PATENT DOCUMENTS

| | | | | |
|---|---|---|---|---|
| 2,026,511 | A | 12/1935 | Storm | |
| 2,113,076 | A | 4/1938 | Bruce | |
| 2,141,708 | A | 12/1938 | Elmendorf | |
| 2,149,026 | A | 2/1939 | McBride | |
| 2,269,926 | A | 1/1942 | Crooks | |
| 2,706,164 | A | 4/1955 | Hervey | |
| 2,740,167 | A | 4/1956 | Rowley | |
| 2,826,521 | A | 3/1958 | Robinson | |
| 2,914,815 | A | 12/1959 | Alexander | |
| 3,234,074 | A | 2/1966 | Bryant | |
| 3,333,384 | A | 8/1967 | Brady | |
| 3,363,378 | A | 1/1968 | Palfey | |
| 3,440,790 | A | 4/1969 | Nerem | |
| 3,488,904 | A | 1/1970 | Schneller et al. | |
| 3,548,559 | A | 12/1970 | Levine | |
| 3,888,061 | A | 6/1975 | Kahr | |
| 4,093,762 | A | 6/1978 | Kiefer | |
| RE30,233 | E | 3/1980 | Lane et al. | |
| 4,242,390 | A | 12/1980 | Nemeth | |
| 4,471,012 | A | 9/1984 | Maxwell | |
| 4,646,494 | A | 3/1987 | Saarinen et al. | |
| 4,694,627 | A | 9/1987 | Omholt | |
| 4,716,700 | A | 1/1988 | Hagemeyer | |
| 4,807,416 | A | 2/1989 | Parasin | |
| 4,937,122 | A | 6/1990 | Talbert | |
| 5,040,582 | A | 8/1991 | Hsu | |
| 5,098,762 | A | 3/1992 | Nakajima | |
| 5,103,614 | A | 4/1992 | Kawaguchi et al. | |
| 5,349,796 | A | 9/1994 | Meyerson | |
| 5,497,589 | A | 3/1996 | Porter | |
| 5,540,025 | A | 7/1996 | Takehara | |
| 5,755,068 | A | 5/1998 | Ormiston | |
| 5,776,580 | A | 7/1998 | Rasmussen et al. | |
| 5,879,781 | A | 3/1999 | Mehta et al. | |
| 5,899,038 | A | 5/1999 | Stroppiana | |
| 5,900,099 | A | 5/1999 | Sweet et al. | |
| 5,968,625 | A | 10/1999 | Hudson | |
| 6,006,486 | A | 12/1999 | Moriau et al. | |
| 6,182,413 | B1 | 2/2001 | Magnusson | |
| 6,209,278 | B1 | 4/2001 | Tychsen | |
| 6,212,838 | B1 | 4/2001 | Eda | |
| 6,247,285 | B1 | 6/2001 | Moebus | |
| 6,314,759 | B1 | 11/2001 | Nihashi | |
| 6,332,733 | B1 | 12/2001 | Hamberger et al. | |
| 6,505,452 | B1 | 1/2003 | Hannig et al. | |
| 6,546,691 | B2 | 4/2003 | Leopolder | |
| 6,591,568 | B1 | 7/2003 | Palsson | |
| 6,606,834 | B2 | 8/2003 | Martensson et al. | |
| 6,676,199 | B2 | 1/2004 | Buisson et al. | |
| 6,679,011 | B2 | 1/2004 | Beck et al. | |
| 6,722,809 | B2 | 4/2004 | Hamberger et al. | |
| 6,769,218 | B2 | 8/2004 | Pervan | |
| 6,786,019 | B2 | 9/2004 | Thiers | |
| 6,804,926 | B1 | 10/2004 | Eisermann | |
| 6,933,043 | B1 | 8/2005 | Son et al. | |
| 6,953,105 | B2 | 10/2005 | Rust et al. | |
| 7,021,346 | B2 | 4/2006 | Chang | |
| 7,506,481 | B2 | 3/2009 | Grafenauer | |
| 7,665,263 | B2 | 2/2010 | Yau | |
| 7,971,401 | B2 | 7/2011 | Preiss | |
| 7,993,731 | B2 * | 8/2011 | Miller et al. | 428/212 |
| 8,029,880 | B2 | 10/2011 | Liu | |
| 8,061,104 | B2 | 11/2011 | Pervan | |
| 8,209,841 | B2 | 7/2012 | Kanade et al. | |
| 8,245,477 | B2 | 8/2012 | Pervan | |
| 8,381,488 | B2 | 2/2013 | Pervan | |
| 8,418,427 | B2 | 4/2013 | Strickland et al. | |
| 8,720,151 | B2 | 5/2014 | Pervan | |
| 2002/0059765 | A1 | 5/2002 | Nogueira et al. | |
| 2003/0010434 | A1 | 1/2003 | Grenier | |
| 2003/0033777 | A1 | 2/2003 | Thiers et al. | |
| 2003/0233809 | A1 | 12/2003 | Pervan | |
| 2004/0226243 | A1 * | 11/2004 | Lin et al. | 52/384 |
| 2005/0069674 | A1 | 3/2005 | Chang | |
| 2005/0123728 | A1 | 6/2005 | Reichwein et al. | |
| 2005/0208255 | A1 * | 9/2005 | Pervan | 428/60 |
| 2006/0154015 | A1 | 7/2006 | Miller et al. | |
| 2007/0151189 | A1 * | 7/2007 | Yang | 52/582.2 |
| 2007/0292656 | A1 | 12/2007 | Handojo | |
| 2008/0008871 | A1 | 1/2008 | Pervan | |
| 2008/0028707 | A1 | 2/2008 | Pervan | |
| 2008/0184647 | A1 * | 8/2008 | Yau | 52/589.1 |
| 2008/0199676 | A1 * | 8/2008 | Bathelier et al. | 428/223 |
| 2010/0247861 | A1 * | 9/2010 | Mitchell | 428/142 |
| 2010/0281810 | A1 * | 11/2010 | Ruland | 52/588.1 |
| 2010/0297380 | A1 | 11/2010 | Szakola et al. | |
| 2010/0300030 | A1 * | 12/2010 | Pervan et al. | 52/588.1 |
| 2011/0023405 | A1 | 2/2011 | Moriau et al. | |
| 2011/0154763 | A1 * | 6/2011 | Bergelin et al. | 52/309.1 |
| 2012/0015131 | A1 | 1/2012 | Akarsu et al. | |
| 2012/0042595 | A1 | 2/2012 | De Boe | |
| 2013/0047536 | A1 | 2/2013 | Pervan | |
| 2013/0145707 | A1 | 6/2013 | Pervan | |
| 2013/0199120 | A1 | 8/2013 | Bergelin et al. | |
| 2014/0000197 | A1 | 1/2014 | Pervan | |

FOREIGN PATENT DOCUMENTS

| | | | |
|---|---|---|---|
| CH | 173818 | | 12/1934 |
| CH | 310904 | | 11/1955 |
| CN | 2401633 | Y | 10/2000 |
| DE | 908 913 | C1 | 4/1954 |
| DE | 2 205 232 | A1 | 8/1973 |
| DE | 33 43 601 | A1 | 6/1985 |
| DE | 33 43 601 | C2 | 6/1985 |
| DE | 43 13 037 | C1 | 8/1994 |
| DE | 201 08 358 | U1 | 9/2001 |
| DE | 100 49 172 | A1 | 4/2002 |
| EP | 0 652 340 | A1 | 5/1995 |
| EP | 1 262 609 | A1 | 12/2002 |
| FI | 21805 | | 1/1947 |
| FR | 1.464.112 | | 7/1966 |
| FR | 2 718 175 | A1 | 10/1995 |
| GB | 291113 | | 11/1928 |
| GB | 519198 | | 3/1940 |
| JP | 2-194269 | A | 7/1990 |
| JP | 2-121236 | U | 10/1990 |
| JP | 5-21027 | U | 3/1993 |
| JP | 6-158831 | A | 6/1994 |
| JP | 6-280376 | A | 10/1994 |
| JP | 7-102745 | A | 4/1995 |
| JP | 7-310426 | A | 11/1995 |
| JP | 8-021071 | A | 1/1996 |
| JP | 8-068191 | A | 3/1996 |
| JP | 8-300316 | A | 11/1996 |
| JP | 9-38906 | A | 2/1997 |
| JP | 10-299230 | A | 11/1998 |
| JP | 11-324292 | A | 11/1999 |
| JP | 2000-027418 | A | 1/2000 |
| JP | 2000-226932 | A | 8/2000 |
| JP | 2000-265652 | A | 9/2000 |
| JP | 2001-145980 | A | 5/2001 |
| JP | 2001-329681 | A | 11/2001 |
| JP | 2003-027731 | A | 1/2003 |
| JP | 2003-080509 | A | 3/2003 |
| KR | 2007-0000322 | A | 1/2007 |
| NL | 1008945 | C1 | 10/1999 |
| WO | WO 94/26999 | A1 | 11/1994 |
| WO | WO 96/27719 | A1 | 9/1996 |
| WO | WO 96/27721 | A1 | 9/1996 |
| WO | WO 97/38187 | A1 | 10/1997 |
| WO | WO 97/47834 | A1 | 12/1997 |
| WO | WO 99/05073 | A1 | 2/1999 |
| WO | WO 99/66152 | A1 | 12/1999 |
| WO | WO 00/66856 | A1 | 11/2000 |
| WO | WO 01/54897 | A1 | 8/2001 |
| WO | WO 03/016655 | A | 2/2003 |
| WO | WO 03/087498 | A1 | 10/2003 |
| WO | WO 2004/108373 | A1 | 12/2004 |
| WO | WO 2006/027357 | A1 | 3/2006 |
| WO | WO 2006/043893 | A1 | 4/2006 |
| WO | WO 2007/149051 | A1 | 12/2007 |
| WO | WO 2009/065769 | A2 | 5/2009 |
| WO | WO 2009/065769 | A3 | 5/2009 |

(56) References Cited

FOREIGN PATENT DOCUMENTS

OTHER PUBLICATIONS

Pervan, Darko, U.S. Appl. No. 13/932,406 entitled "Panel Forming," filed in the U.S. Patent and Trademark Office Jul. 1, 2013.
International Search Report issued in PCT/SE2013/050458, Jul. 17, 2013, Patent-och registreringsverket, Stockholm, SE, 5 pages.
U.S. Appl. No. 14/248,018, Pervan.
Pervan, Darko, U.S. Appl. No. 14/248,018 entitled "Floorboards for Floorings," filed in the U.S. Patent and Trademark Office Apr. 8, 2014.
Pervan, Darko (Author)/Valinge Innovation, Technical Disclosure entitled "VA073a Zip Loc," Sep. 13, 2011, IP.com No. IPCOM000210869D, IP.com PriorArtDatabase, 36 pages.
Brännström, Hans, et al., U.S. Appl. No. 14/468,763 entitled "A Method for Producing a Lamella Core," filed in the U.S. Patent and Trademark Office on Aug. 26, 2014.

* cited by examiner

BUILDING PANELS OF SOLID WOOD

FIELD OF THE INVENTION

The present invention relates to building panels, such as floor panels, a wall panel, a ceiling panel, a furniture component or the like. The building panels comprise an upper solid wood element and a lower solid wood element, and are provided with a mechanical locking system. The present invention also relates to a method for producing the building panel with the locking system and the upper and lower solid wood elements.

TECHNICAL BACKGROUND

Building panels of wood provided with a mechanical locking system are known and disclosed in, e.g., WO03/087498.

Furthermore, building panels provided with a mechanical locking system comprising a displaceable and resilient tongue cooperating with a tongue groove for vertical locking are known and disclosed in, e.g., WO2006/043893. The tongue is a separate part and is made of, e.g., plastic, and positioned in an insertion groove at an edge of a panel. The tongue is pushed into the insertion groove during a vertical assembling of the panels and springs back into the tongue groove of an adjacent panel when the panels have reached a locked position.

Although the description relates to floor panels, the description of techniques and problems thereof is applicable also to other applications, such as wall panels, ceiling panels, furniture, etc.

A drawback with the known building panels that are provided with a mechanical locking system is that a gap may arise between two adjacent building panels which are locked together, when the moisture content of the building panels decreases. The mechanical locking system may also break down due to an asserted tension load that is caused by the decrease of the moisture content.

The above description of various known aspects is the applicant's characterization of such, and is not an admission that any of the above description is considered as prior art.

SUMMARY

One object of the present invention is to provide an improvement over the above described techniques and prior art.

A further object is to provide solid wood building panels provided with a locking system that are configured such that when installed indoors no gaps or smaller gaps arise when the climate changes from wet to dry. An additional object is to configure the mechanical locking system such that it does not break when the climate changes from wet to dry.

Another object is to reduce or eliminate warping of the building panels and to provide an efficient production method.

At least some of these and other objects and advantages that will be apparent from the present description have been achieved by building panels according to a first aspect of the invention. The building panels, preferably floor panels, each comprise an upper first element of solid wood fixed to a lower second element of solid wood. The first and the second element are preferably of different wood species. The building panels are provided with a mechanical locking system, which comprises a locking strip at a first edge of a first building panel. The locking strip is provided with a locking element, which is configured to cooperate with a locking groove at a second edge of a second building panel for horizontal locking of the first and the second building panel when a tension force is applied. The fibre direction of the first element and the second element is essentially along the first and the second edge. The second element has about the same or higher moisture shrinkage value than the first element, preferably in a range of about 0.2 to about 5 percent, more preferably in a range of about 0.5 to about 2 percent and most preferably about 1 percent higher. The locking strip comprises material of the second element.

The first and the second building panels are preferably essentially identical.

The first and the second element may be fixed directly to each other by glue.

The building panels may each comprise several second elements, each comprising the same features as the second element described above, in the direction of the first and second edge. Adjacent second elements may be attached to each other by a glued joint, preferably a glued finger joint.

The first and/or the second element preferably extend along essentially the whole first and/or the whole second edge. There may however be two, three or more second elements along the first and/or the second edge.

Building panels of wood are affected by moisture in the environment. The building panels according to an embodiment of the invention are primarily intended to be installed indoor. The indoor climate is during the winter dry, with a low degree of moisture, and wet during the summer with a high degree of moisture. The indoor temperature is normally essentially the same but the relative humidity is low during the winter and high during the summer. Wood building panels shrink at a low relative humidity and swell at high relative humidity. The shrinkage and the swelling of the building panels create a problem since gaps between two adjacent and assembled building panels may arise when the building panels shrink. The shrinkage and the swelling are higher for solid wood product compared to wood based product, such as HDF boards and plywood boards. Thus, the problems with gaps with respect to solid wood products are greater.

Embodiments of the invention can solve the problem related to the shrinking of installed building panels in a direction perpendicular to the first and the second edge. Wood elements swell and shrink far more in a direction perpendicular to the fibre direction than in a direction parallel to the fibre direction. The first and the second element of the building panels both have a fibre direction parallel to the first edge and the second edge, and so the problems with shrinking and swelling of the building panels are the greatest at the first and the second edge of two adjacent panels locked together by the mechanical locking system.

When the building panels shrink, the locking strip locks two adjacent and assembled building panels together, and consequently a tension load is asserted on the locking strip. According to some embodiments of the invention, the locking strip has a higher moisture shrinkage value than the upper first element. The locking strip therefore shrinks more and consequently pulls the building panels together with a greater force such that a gap may be avoided or at least minimized.

If the first element has a fibre direction parallel to the first and the second edge, the second element should also have a fibre direction parallel to the first and the second edge in order to have a locking strip that shrinks more than the first element.

An alternative of different wood species is a first and a second element with different orientation of annual rings to obtain the different values of moisture shrinkage.

The thickness of the first element may be more than about ⅓, preferably more than about half, or even more than about ⅔, of the thickness of the building panels.

The second element may be used to balance the first element to avoid cupping of the panel. A thinner second element may be used to balance the first element, since it shrinks more than the first element.

The mechanical locking system may comprise a tongue at the second edge of the second building panel, configured to cooperate with a tongue groove at the first edge of the first building panel for vertical locking of the first and the second building panel.

The mechanical locking system may comprise a tongue at the first edge of the first building panel, configured to cooperate with a tongue groove at the second edge of the second building panel for vertical locking of the first and the second building panel.

The borderline between the first and the second element is preferably below an upper surface of tongue groove. Making the first element thicker than the second element allows for more sanding of an installed floor.

An improved flooring may be obtained if the tongue is positioned below a horizontal plane which is spaced from the front face with about one third of the floor thickness, which allows more sanding of an installed floor and the surface to be renewed several times.

The upper part of the tongue is preferably located in the lower part of the first element.

The locking strip and the locking element are preferably formed in the second element.

The thickness of the locking strip is preferably larger than the vertical extension of the cooperating locking surfaces between the locking element and the locking groove.

The locking strip and the locking element may protrude horizontally beyond the upper edge. The protruding part of the locking strip and the locking element may be larger than the thickness of the second element.

The second element may be wider than the first element and extend essentially under the whole first element.

The second element may extend from the locking element at the first edge of the first panel, and at least to the locking groove at a second edge of the first panel.

The annual rings of the first and the second element may be oriented radially or tangentially. The orientation of the annual rings means in this description the orientation in the width direction of the first or the second element, i.e., in a direction perpendicular to the first and the second edge. In an embodiment the first element, which preferably has essentially radially oriented annual rings, is combined with the second element, which preferably has tangential annual rings. The moisture shrinkage value is higher for elements with tangential annual rings than for elements with radial annual rings and also for elements of the same wood species. Thus the first and the second element may be of the same wood species and still have the desired difference in moisture shrinkage.

The first and the second element may each have a mix of radially and tangentially oriented annual rings. These first and second elements are for embodiments with a mix of different wood species.

Embodiments with a tangentially oriented annual ring in both the first element and the second element are preferably arranged with opposite orientations.

In a preferred embodiment, the first element has radially and tangentially oriented annual rings combined with the second element which has radially and tangentially oriented annual rings, wherein the first and the second element are of different wood species with a desired difference in moisture shrinkage.

The second element may be attached to the first element, preferably with a tongue and groove connection, which preferably is fixed with glue.

The building panels may each comprise several second elements, each comprising the same features as said second element described above, in a direction perpendicular to the direction of the first and second edge. Adjacent second elements may be attached to each other by a glued joint, preferably a glued finger joint or a glued tongue and groove joint.

The locking strip, and preferably the locking element, may be formed out of the second element by e.g., by milling.

Under a preferred embodiment, the first element is of oak combined with the second element of beech, birch or maple. Under another embodiment the first element is preferably of ash combined with the second element of beech, birch or maple.

The mechanical locking system may comprise an upper part of the first edge and an upper part of the second edge that are configured to cooperate, at an essentially vertical plane, when a compression force is applied due to swelling of the building panels.

The depth of the tongue groove and the protruding part of the tongue measured from the essentially vertical plane are preferably smaller than the thickness of the second element. This can prevent the tongue groove from opening in dry conditions, especially when the tongue grove is formed of two materials that may bend in opposite directions.

The upper and lower surfaces of the building panels may be covered by a moisture protection layer, such as a lacquered layer, that delays the effect of the change of the indoor climate and its change of the degree of moisture. Also, the mechanical locking system may be covered by a moisture protection layer.

The mechanical locking system may comprise a locking strip at a third edge of the first building panel. The locking strip may be provided with a locking element which is configured to cooperate with a locking groove at a fourth edge of a third building panel for horizontal locking of the first and the third building panel when a tension force is applied. The first and the third building panels are preferably essentially identical. The first and the second edge are preferably long edges and the third and the fourth edges are preferably short edges.

The mechanical locking system may comprise a tongue at the third edge of the first building panel, the tongue configured to cooperate with a tongue groove at the fourth edge of the third building panel for vertical locking of the first and the third building panel.

The mechanical locking system may comprise a tongue at the fourth edge of the third building panel, the tongue configured to cooperate with a tongue groove at the third edge of the first building panel for vertical locking of the first and the second building panel.

The tongue at the third or at the fourth edge may be a displaceable tongue configured to enable assembling by a vertical movement. The tongue may be of a plastic material or of a wood based material such as HDF. The tongue may comprise protruding parts which match a recess in a lower lip of the tongue groove, with which the tongue cooperates.

A second aspect of the invention involves building panels, preferably floor panels, each comprising an upper first element of solid wood fixed to a lower second element of solid wood. The first and the second elements are of different wood species. The building panels are provided with a mechanical locking system, which comprises a locking strip at a first edge of a first building panel. The locking strip is provided with a locking element which is configured to cooperate with a locking groove at a second edge of a second building panel for horizontal locking of the first and the second building panels when a tension force is applied. The fibre direction of the first and the second elements is preferably essentially along the first and the second edge. The toughness of the second element is higher than the toughness of the first element. The locking strip comprises material of the second element. This makes it possible to produce building panels of hard material and brittle material, such as oak, on the top surface.

Commonly used hard wood species, such as oak, are brittle. Embodiments of the invention comprises a locking strip of a material with high toughness, such as beech or birch, to avoid the locking strip breaking when a tension load is asserted due to shrinking of the building panels or when a load is applied on the building panels. The load may be applied by, e.g., walking on assembled building panels installed as a floor.

The definition of the mechanical locking system and its configuration at the first, the second, the third and the fourth edge, and the thickness relationships of the first and second elements that are described above in relation to embodiments of the first aspect of the invention are applicable also to the second aspect of the invention. Embodiments of the second aspect may also comprise several second elements as described above for embodiments of the first aspect.

The invention may be particularly useful for thin floor panels with a thickness less than about 14 mm, since the material available at the edge of the building panel for producing the locking strip and the locking element is limited. The toughness of the material of locking strip therefore needs to be higher.

Under a preferred embodiment of the second aspect of the invention, the first element is preferably of oak combined with the second element of beech, birch or maple. Under another embodiment the first element is of ash combined with the second element of beech, birch or maple.

The second element may under embodiments of the first and second aspects comprise a separate element.

A third aspect of the invention is a method of producing building panels according to the first aspect or the second aspect. The method comprises the steps of:

cutting a groove in an edge of a first element;

attaching a tongue of a second element into the groove;

forming a top surface of the second element; and forming a locking element, a locking strip and a tongue groove in the second element The forming and/or the cutting are preferably made by milling. The tongue of the second element is preferably fixed by glue in the groove of the first element.

A part of the top surface of the second element may be formed such that it extends to the top surface of the first element to obtain a decorative part at the edge of the building panel.

A forth aspect of the invention is a baseboard for a floating floor comprising floorboards of solid wood, preferably floorboards according to the first or second aspects of the invention. The baseboard comprises an L-shaped metal profile, preferably of aluminium. A first leg of the profile is configured to be attached to a wall and a second leg is configured to be arranged on the front face of a floorboard, and may be provided with recesses such as drill holes. The metal profile may be provided with a decorative surface, e.g., a print, a foil or a wood veneer. A wood strip may be arranged on the first leg. The wood strip is preferably attached together with the first leg to the wall, preferably with fastening elements, which extend through the recesses in the first leg. The length of the second leg is longer than the thickness of the wood strip. The length may be more than two times, or preferably three times, the thickness of the wood strip.

The shrinking and swelling mentioned above may also result in gaps forming between a wall and floorboards assembled in a floating manner. For floorboards comprising solid wood, the gaps may be of a size which requires a baseboard of a considerable extension from the wall. The length of the second leg may extend far enough to cover any gaps that arise and still allow for furniture to be arranged close to the wall.

The thickness of each of the first and the second leg is preferably about 1 mm, more preferably equal or smaller than 1 mm.

BRIEF DESCRIPTION OF THE DRAWINGS

The present invention will by way of example be described in more detail with reference to the appended schematic drawings, which shows embodiments of the present invention.

DETAILED DESCRIPTION

Figure 3A:
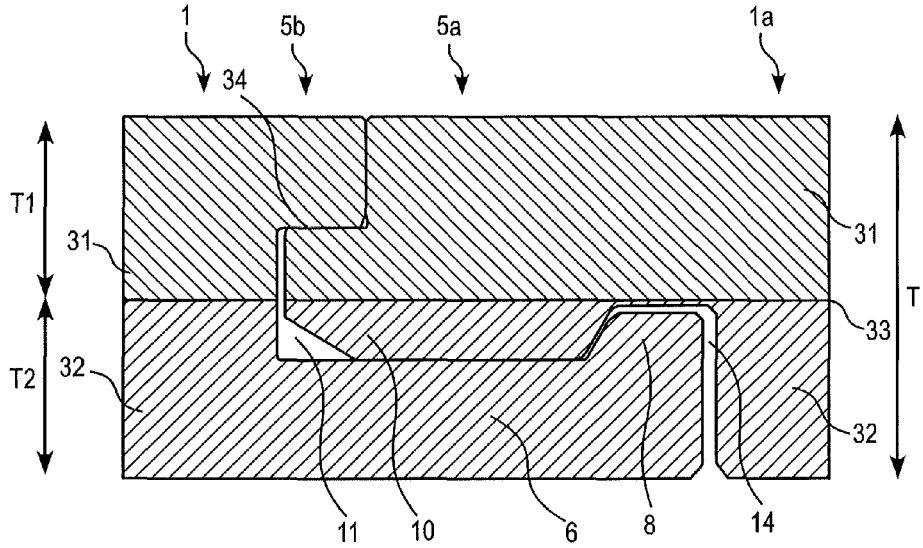
FIGS. 3A-3B show building panels according to embodiments of the invention.

An embodiment of the invention is shown in FIG. 3A. A first floor panel 1, which comprises an upper first solid wood element 31 attached to a lower second wood element 32, is locked to an essentially identical second floor panel 1*a*. The first and the second floor panels 1, 1*a* are provided with a mechanical locking system which comprises, at a first edge 5*b* of the first floor panel 1, a locking strip 6 with a vertically protruding locking element 8. The locking element 8 cooperates with a locking groove 14 at a second edge 5*a* of the second panel 1*a* for horizontally locking of the first and the second panels 1, 1*a*, when a tension force is applied. The first element 31 is preferably attached to the second element 32 by gluing. The mechanical locking system may be formed in the first and the second elements 31, 32 by milling when the first and the second elements 31, 32 are attached to each other.

Figure 7A:
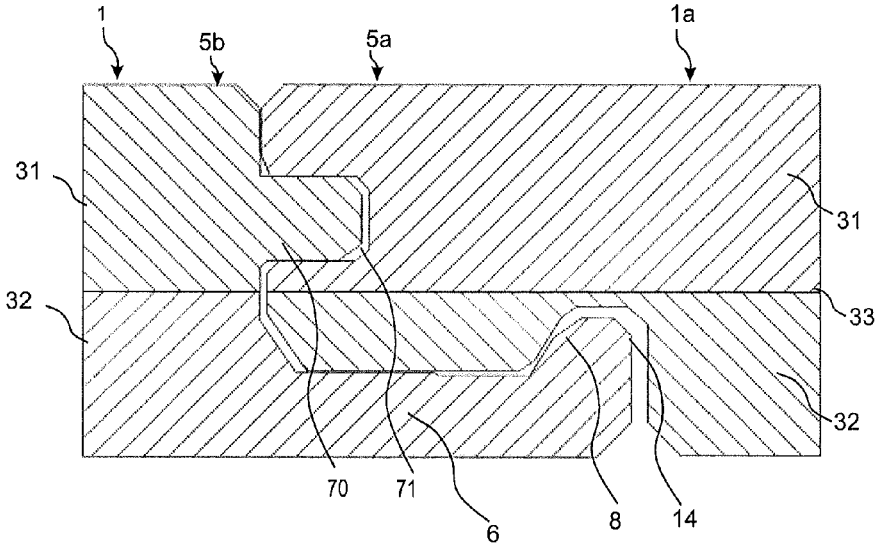
FIGS. 7A-7B show building panels according embodiments of the invention.
Figure 7B:
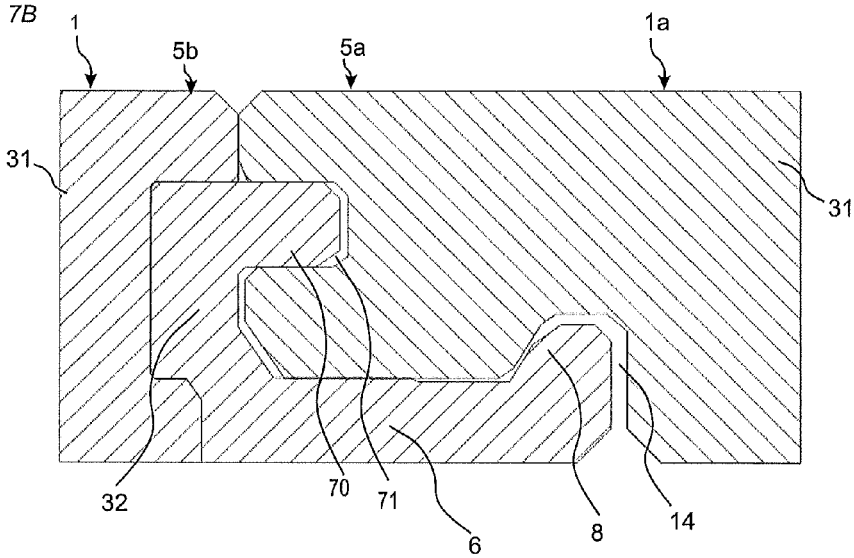

The mechanical locking system may further comprises a tongue groove 11 at the first edge 5*b* of the first floor panel 1 and a tongue 10 at the second edge 5*a* of the second floor panel 1*a*. The tongue 10 and the tongue groove 11 cooperate for vertical locking of the first and the second floor panels 1, 1*a*. A second tongue 70 may also be provided at the first edge 5*b* of the first floor panel 1*a*, and a second tongue groove 71 may be provided at the second edge 5*a* of the second floor panel 1*a*. The second tongue 70 and the second tongue groove 71 cooperate for vertical locking of the first floor panel 1 and the second floor panel 1*a* as is shown in FIGS. 7A-7B.

A locking surface of the locking groove 14 and a locking surface of the locking element 8 cooperate for the horizontal locking. The thickness of the locking strip 6 is preferably larger than the vertical extension of the cooperating locking surfaces.

The thickness T1 of the first element 31 is about the same as the thickness T2 of the second element 32, and the borderline 33 between the first element 31 and the second element 32 is in the middle of the tongue 10 (e.g., below the upper surface 34 of the tongue groove 11). However the thickness T1 of the first element 31 may be greater than the thickness T2 of the second element 32.

The second element 32 may be used to balance the first element 31 to avoid cupping of the floor 1 panel. A thinner second element 32 may be used to balance the first element 31, since it shrinks more than the first element 31.

The locking strip 6 and the locking element 8 protrude horizontally beyond the upper edge of the first edge 5*b*. The protruding part of the locking strip 6 and the locking element 8 is larger than the thickness T2 of the second element 32.

Figure 5A:
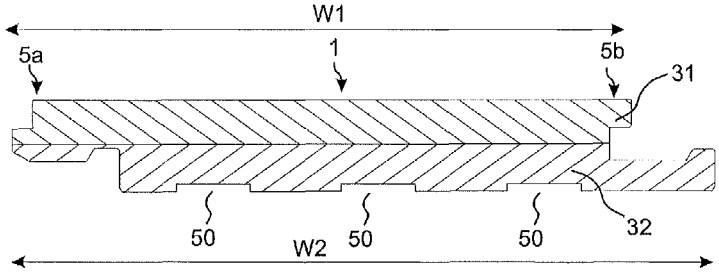
FIGS. 5A-5B show building panels according embodiments of the invention.

The second element 32 has a width W2 which is wider than the width W1 of the first element 31, and the second element 32 extends under the whole first element 31, as is shown in FIG. 5A. The second element 32 extends from the locking element 8 at the first edge 5*b* of the first panel 1, and at least to the locking groove 14 at a second edge 5*a* of the first panel 1.

Figure 1A:
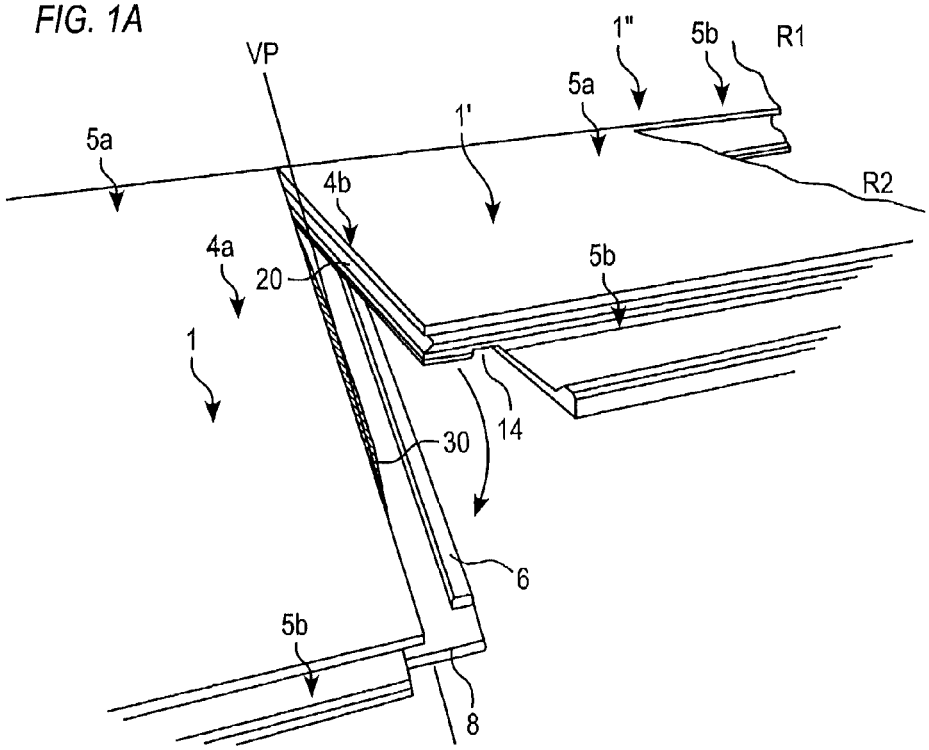
FIGS. 1A-1B show building panels provided with a locking system comprising a separate and resilient tongue.
Figure 1B:
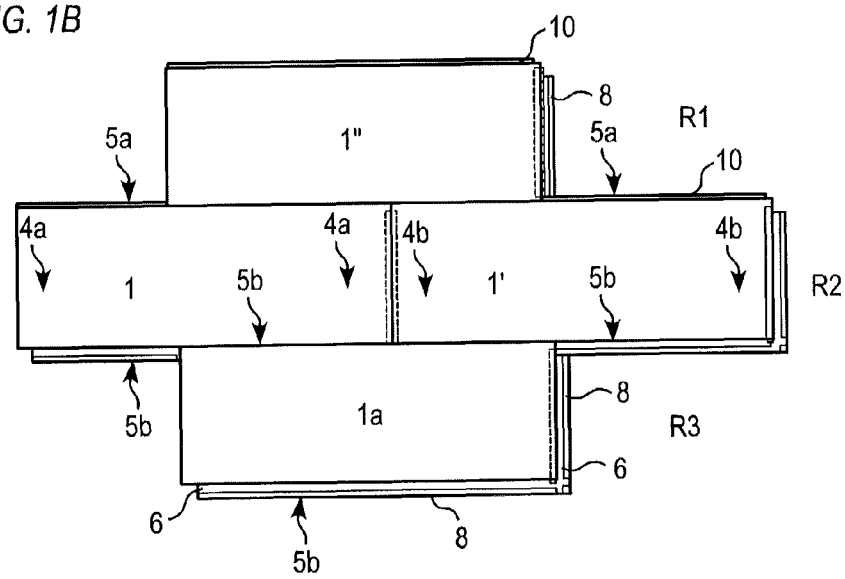

The first edge 5*a* and the second edge 5*b* are preferably long edges that are configured to be assembled by an angling motion, see e.g., FIG. 1B. A third edge 4*a* of the first panel and a fourth edge 4*b* of an essentially identical third panel 1' are preferably short edges and provided with a mechanical locking system allowing assembling by vertical movement. The assembling of the short edges may be achieved simultaneous with the assembling of a long edge 5*a* of the third panel 1' to a long edge 5*b* of a fourth panel 1" by an angling motion as is shown in FIG. 1A.

FIG. 1B discloses identical floor panels in an assembled and locked position. The fourth panel 1" is installed in a first row R1, the first panel 1 and the third floor panel 1' are installed in a second row R2, and the second panel 1*a* is installed in a third row R3.

Figure 2A:
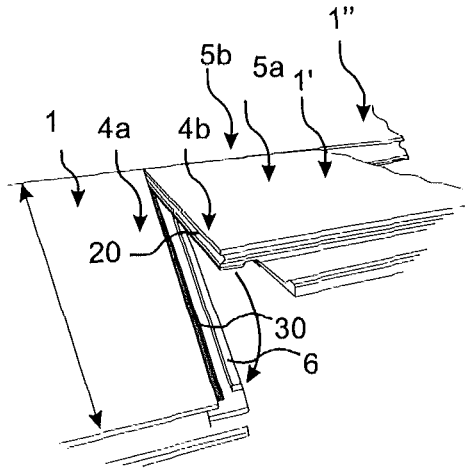
FIGS. 2A-2C show assembling of building panels comprising a locking system with a separate and displaceable tongue.
Figure 2B:
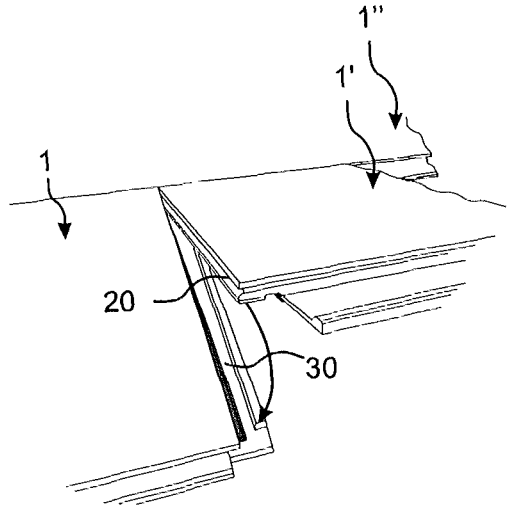
Figure 2C:
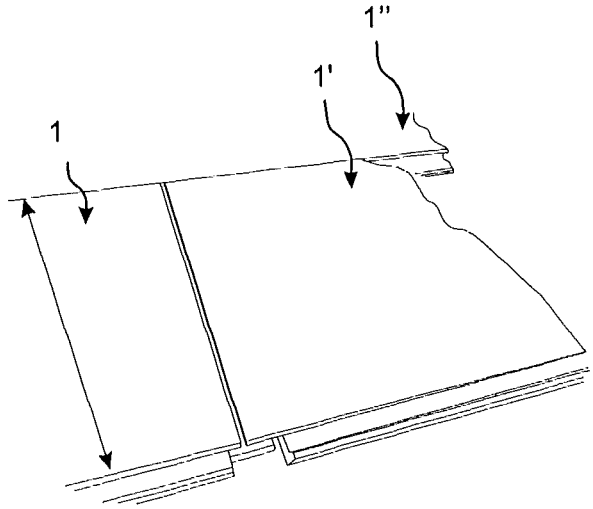

The mechanical locking system at the short edges 4*a*, 4*b* preferably comprises a displaceable and flexible tongue 30 at the third edge 4*a*, which cooperates for vertical locking with a tongue groove 20 at the fourth edge 4*b*. FIGS. 2A-2C illustrate in three sequences the assembling of the short edges 4*a*, 4*b* of the first panel 1 and the third floor panel 1'. The flexible and displaceable tongue 30 is pushed into a displacement groove and springs back into the tongue groove 20. The mechanical locking system at the short edges 4*a*, 4*b* preferably also comprises at the third edge 4*a* a locking strip 6 provided with a locking element 8, which cooperates with a locking groove at the fourth edge 4*b* for horizontally locking of the first floor panel 1 and the third floor panel 1'. As an alternative, the flexible and displaceable tongue 30 may be provided at the fourth edge 4*b* and the tongue groove 20 at the third edge 4*a*.

Figure 6A:
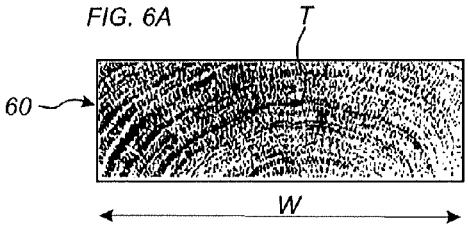
FIGS. 6A-6D show the orientation of the annual rings according to embodiments of the invention.
Figure 6C:
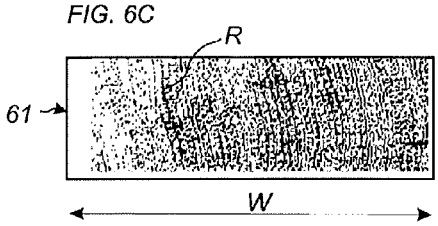
Figure 6B:
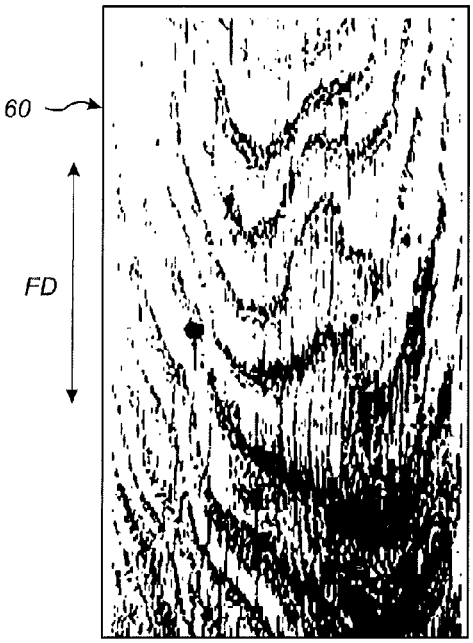
Figure 6D:
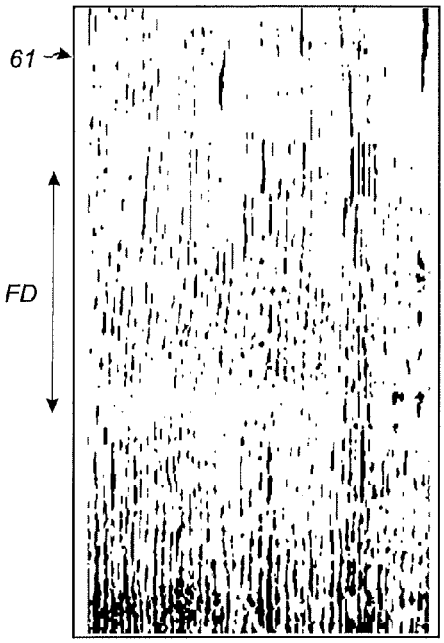
Figure 6E:
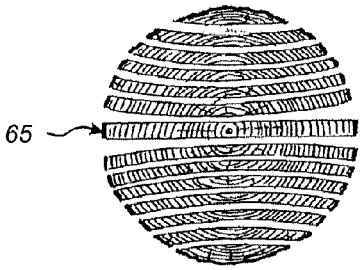
FIGS. 6E-6F show how to obtain a wood element with different orientation of the annual rings.
Figure 6F:
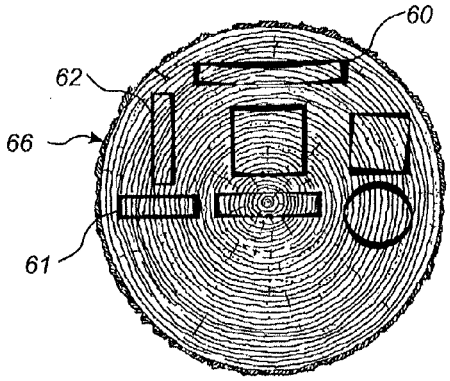

FIG. 6A shows a side view of an element 60 with tangential annual rings T. FIG. 6C shows a side view of an element 61 with radial annual rings R in the width direction W of the element. FIG. 6B shows a top view of the element 60 with the tangential annual rings T, and FIG. 6D shows a top view of the element 61 with the radial annual rings R. The elements 60, 61 have a fibre direction FD that runs perpendicular to the annual rings T, R. The elements 60, 61 are produced by cutting out the elements 60, 61 from a log. In FIG. 6E, the elements are cut out from a log 65 by parallel cuts throughout the log 65. FIG. 6F shows how to obtain elements from a log 66 with tangential annual rings (see element 60), elements with radial annual rings (see element 61), and elements with a mix of radial and tangential annual rings (see, e.g., element 62). The moisture shrinkage values for elements from the same wood species are higher for elements with tangential annual rings than for elements with radial annual rings. There is also a difference in the moisture shrinkage value between different wood species. The moisture shrinkage value of oak is for example lower than for beech or birch.

An embodiment of the invention may comprise an upper first element 31 of oak and a lower second element 32 of birch or beech. If the annual rings orientation of the first and the second elements 31, 32 are the same, the second element 32 shrinks more than the first element 31. When the first and the second floor panels 1, 1*a* shrink, the locking strip 6 locks the first and the second floor panels 1, 1*a* together and consequently a tension load is asserted on the locking strip 6. Depending on the configuration of the locking element 8, the locking groove 14 and the cooperating locking surfaces, the locking strip 6 may also be bent down. The locking strip 6 has a higher moisture shrinkage value than the upper first element 31, and therefore shrinks more when the moisture degree is decreased. Consequently, the locking strop 6 pulls the first and the second floor panels 1, 1*a* together with a greater force such that a gap may be avoided or at least minimized.

A floor panel of solid wood shrinks more than floor panels of, e.g., HDF or an interlocked construction such as plywood with layers with perpendicular fibre directions. The tension force asserted is thus high. Therefore, it is an advantage to have a locking strip 6 of a wood species with high toughness such as beech or birch.

To avoid gap or at least minimize the gap, the fibre direction FD of the first and the second elements 31, 32 should be the same since the swelling in a direction perpendicular to the fibre direction is greater than in a direction parallel to the fibre direction.

The first and the second floor panels 1, 1*a* swell when the moisture degree is increased and a compression force is asserted at an essential vertical plane at an upper edge of the first and the second edges 5*b*, 5*a* of the first and the second floor panels 1, 1*a*, respectively.

The width W2 of the second element 32 may be greater than the width W1 of the first element 31, as is shown in FIG. 5A. The second element 32 preferably extends from the locking element to the tip of the tongue. The thickness T1 of the first element 31 is preferably more than about half, preferably more than about ⅔, of the thickness of the building panels, as is shown in FIG. 3A. The total thickness of the building panels T is about the thickness T1 of the first element 31 plus the thickness T2 of the second element 32.

Figure 3B:
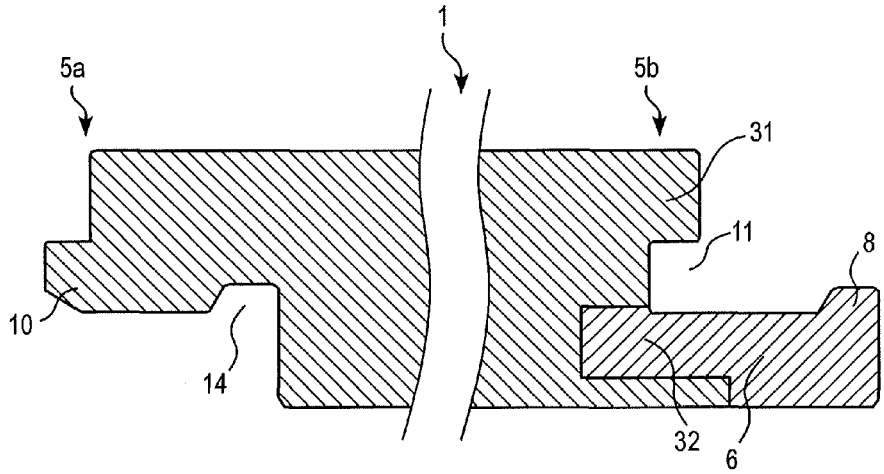
Figure 4A:
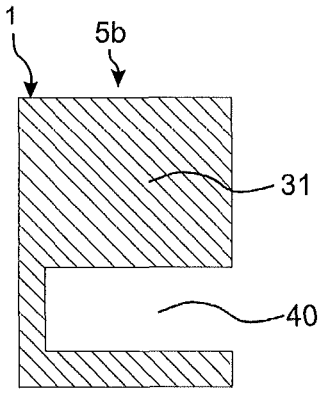
FIGS. 4A-4D show a method to produce a building panel according to an embodiment of the invention.
Figure 4B:
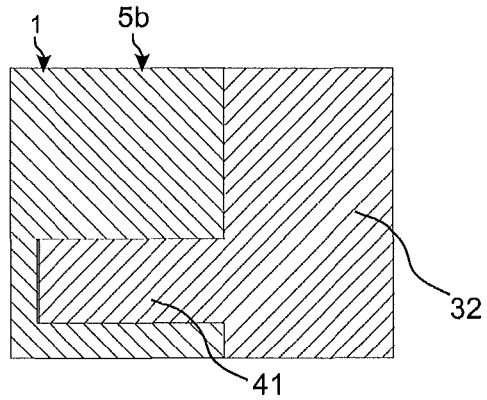
Figure 4C:
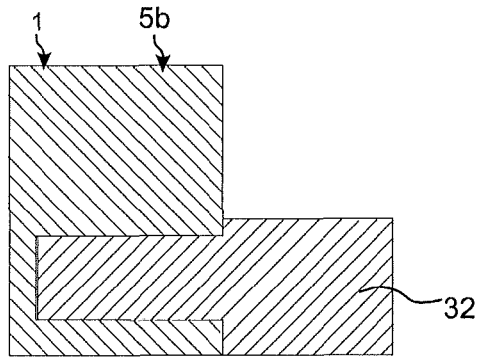
Figure 4D:
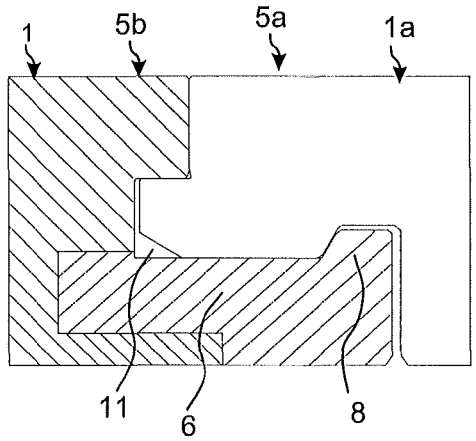
Figure 5B:
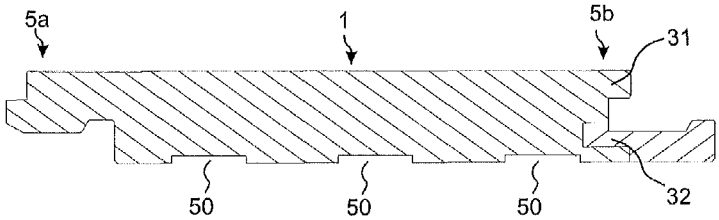

FIG. 5B shows an embodiment in which the second element 32 is attached to the first element 31 at an edge of the first element. FIGS. 4A-D show a method to produce such an embodiment. A groove 40 is cut out in the edge of a first element 31 (FIG. 4A). A second element 32 with a tongue 41 is inserted in the groove 40 (FIG. 4B). A top surface of the second element 32 is formed (FIG. 4C). In another embodiment, a part of the top surface extends to the top surface of the first element 31 to obtain a decorative part at the edge 5*b* of the floor panel 1. A locking element 8, a locking strip 6 and a tongue groove 11 is formed in the second element 32 (FIG. 4D) which can result in the configuration shown in FIG. 3B.

Grooves 50 may be formed in the second element 32, as is shown in FIGS. 5A and 5B, at the backside of the floor panel 1, to minimize the cupping of the floor panel 1.

Figure 5C:
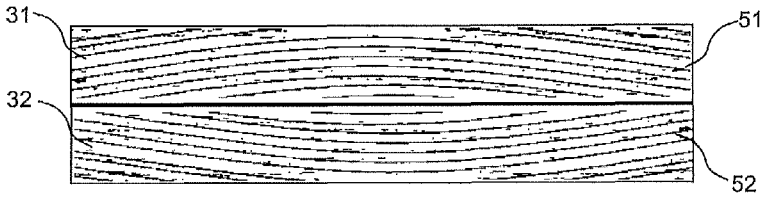
FIGS. 5C-5D show the orientation of the annual rings according to embodiments of the invention.
Figure 5D:
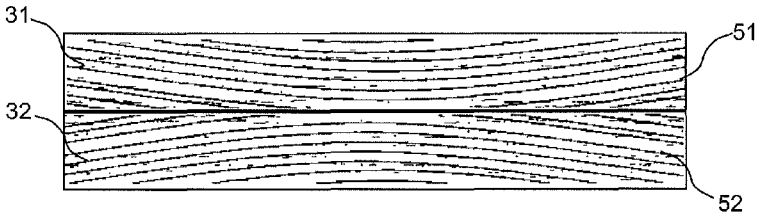

FIGS. 5C and 5D show that if a first and a second element 31, 32 are used that both have tangential annual rings 51, 52, the orientation of the annual rings of the first and the second elements 31, 32 are preferably in an opposite direction.

Figure 8A:
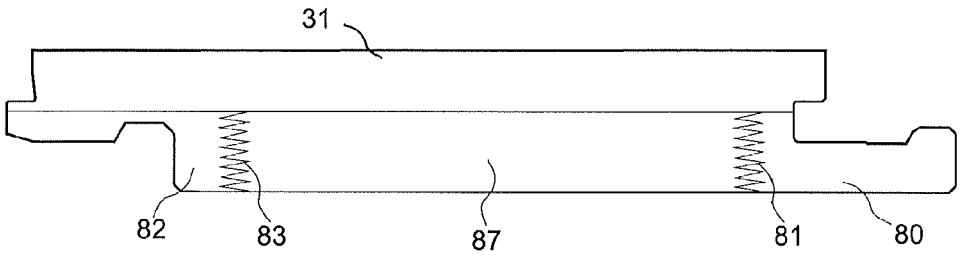
FIGS. 8A-8B show building panels having glued joints according embodiments of the invention.

FIG. 8A shows a building panel provided with several second elements 80, 82, 87, each comprising the features of the second element discussed above. A first one 82 of the second elements, is arranged at the first edge 5*a* of the building panel, a second one 80 of the second elements is arranged at the second edge 5*a* of the building panel, and a third one 87 of the second elements is arranged between the first and the second ones 80, 82 of the second element. Adjacent second elements may be attached to each other by a glued joint 81, 83, preferably a glued finger joint as is shown in FIG. 8A, or a glued tongue and groove joint (not shown).

Figure 8B:
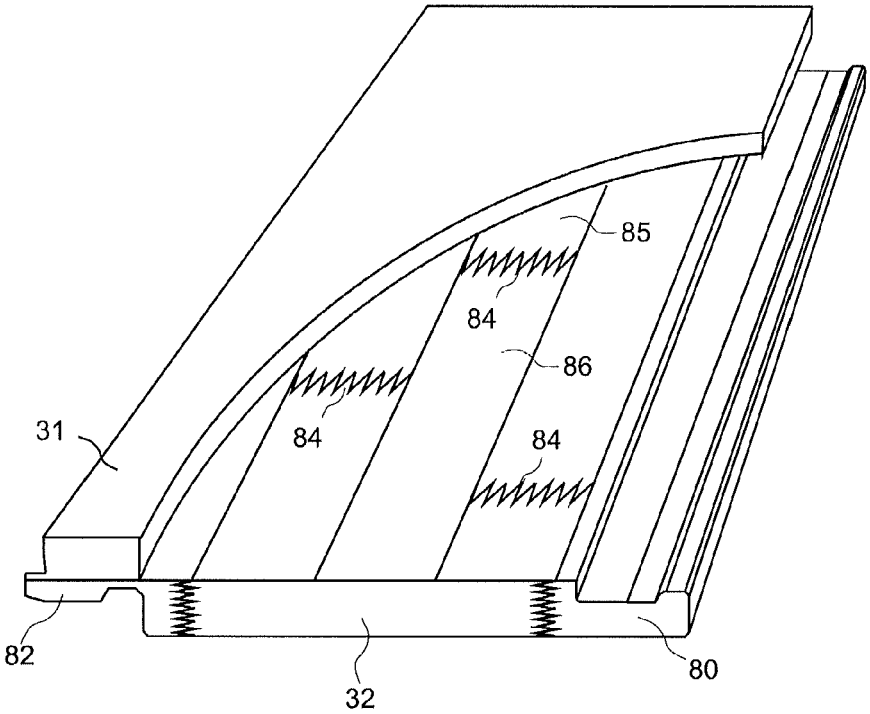

The building panels may comprise several second elements 85, 86, each comprising the features of the second element discussed above, in the direction of the first and second edge, as is shown in FIG. 8B. Adjacent second elements may be attached to each other by a glued joint 84, preferably a glued finger joint. FIG. 8B shows an embodiment comprising several second elements 85, 86, preferably glued together along adjacent edges, also in a direction perpendicular to the direction of the first and second edge.

Figures 9A, 9B:
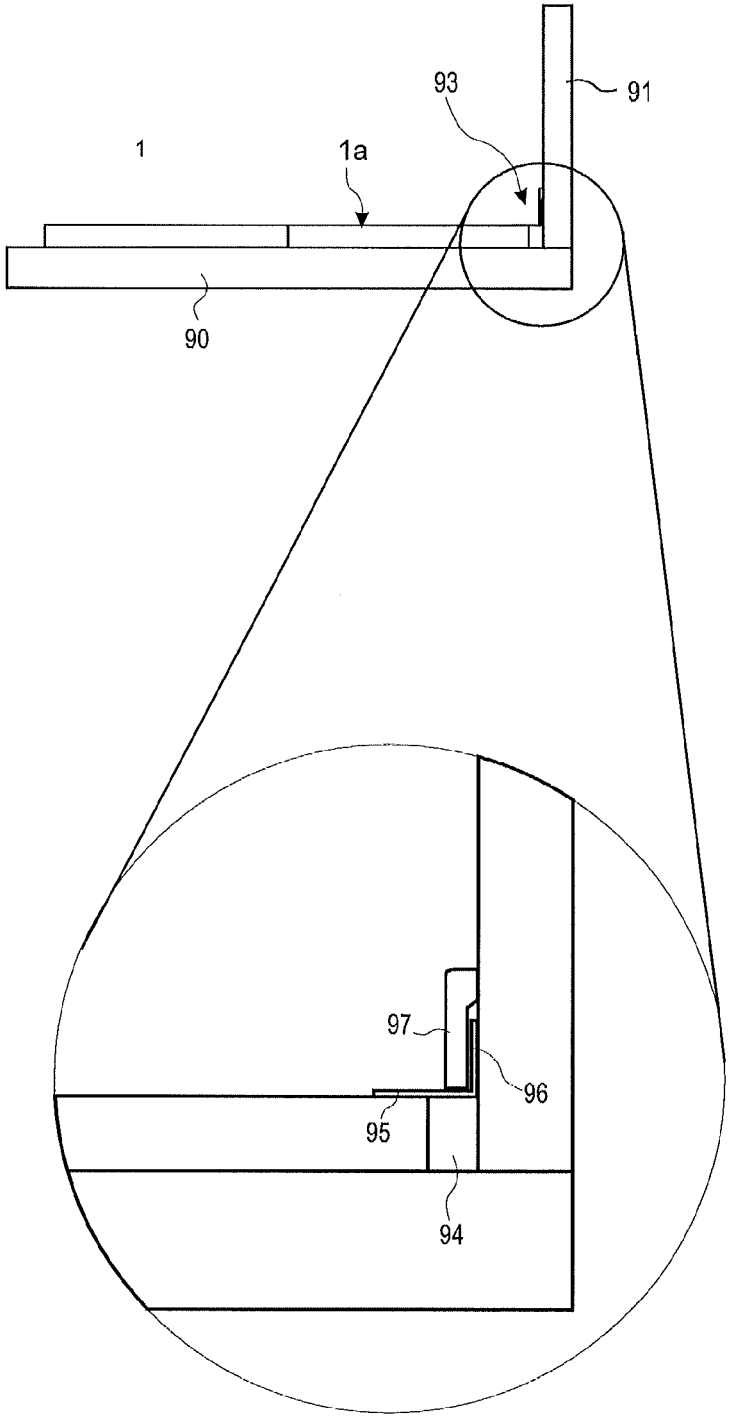
FIGS. 9A-9B show building panels and a baseboard according to an embodiment of the invention.

A baseboard for a floating floor comprising floorboards 1, 1*a* of solid wood is shown in FIG. 9A. FIG. 9B shows an enlargement of the encircled area in FIG. 9A. The floorboards are installed on a subfloor 90. The baseboard 93 comprises an L-shaped metal profile, preferably of aluminium. A first leg 96 of the metal profile is attached to a wall 91 and a second leg 95 is arranged on the front face of a floorboard 1*a*. The first leg 96 and may be provided with recesses such as drill holes (not shown). The metal profile may be provided with a decorative surface, e.g., a print, a foil or a wood veneer (not shown). A wood strip 97 is arranged on the first leg 96. The wood strip 97 is attached together with the first leg 96 to the wall 91, preferably with fastening elements which extend through the recesses in the first leg 96. The length of the second leg 95 is longer than the thickness of the wood strip 97.

The second leg 95 covers a gap 94 between the wall 91 and the floorboards 1, 1*a* that are assembled in a floating manner. The baseboard may cover a large gap and still allow for furniture to be arranged close to the wall 91.

The thickness of the first and the second legs, 96, 95 is preferably about 1 mm, more preferably equal or smaller than 1 mm. The wood strip 97 may be any standard wood moulding, which is provided with a recess at its backside that matches the thickness of the first leg 96.

Examples of moisture shrinkage values for different wood species and annual rings orientation are listed in the table below. An estimation of the shrinkage values for an element with mixed annual rings orientation can be calculated as average of the Radial and the Tangential value. The table below also list figures relevant for the toughness (Impact Bending, Tension Perpendicular to Grain and Work to Maximum Load).

| | Shrinkage from green to ovendry moisture content | | Impact | Tension Perpendicular | Work to Maximum |
|---|---|---|---|---|---|
| Species | Radial (%) | Tangential (%) | Bending (mm) | to Grain (kPa) | Load kJ/m3 |
| Oak white | 4.4 | 8.8 | 940 | 5500 | 102 |
| Oak red | 4.0 | 8.6 | 1090 | 5500 | 100 |
| Ash | 5.0 | 7.8 | 890 | 4800 | 103 |
| Maple | 4.8 | 10.0 | 990 | — | 114 |
| Beech | 5.5 | 12.0 | 1040 | 7000 | 104 |
| Birch | 7.3 | 9.5 | 1400 | 6300 | 143 |

The data above is from "Wood Handbook—Wood as an Engineering Material", from USDA United States Department of Agriculture; Forest Product Labaratory; General Technical Report FPL-GTR-113.

The invention claimed is:

1. A set of building panels, each building panel comprising an upper first element of solid wood fixed to a lower second element of solid wood, the upper first element and the lower second element being of different wood species, the building panels provided with a mechanical locking system which comprises a locking strip at a first edge of a first building panel, the locking strip provided with a locking element configured to cooperate with a locking groove at a second edge of a second building panel for horizontal locking of the first and second building panels when a tension force is applied to the first and second building panels, wherein a fibre direction of the upper first element and the lower second element is essentially along the first and the second edges, the lower second element having a higher moisture shrinkage value than the upper first element, and the locking strip comprises material of the lower second element.

2. The set of building panels as claimed in claim 1, wherein a thickness of the upper first element is about equal to or is greater than ⅓ of a thickness of the lower second element.

3. The set of building panels as claimed in claim 1, wherein the mechanical locking system comprises a tongue at the second edge of the second building panel, the tongue configured to cooperate with a tongue groove at the first edge of the first building panel for vertical locking of the first and second building panels.

4. The set of building panels as claimed in claim 3, wherein a borderline between the upper first element and the lower second element is below an upper surface of the tongue groove.

5. The set building panels as claimed in claim 1, wherein the first and second building panels are essentially identical.

6. The set of building panels as claimed in claim 1, wherein the lower second element is wider than the upper first element, and extends essentially under the whole first element.

7. The set of building panels as claimed in claim 1, wherein the lower second element extends from the locking element at the first edge of the first panel, and at least to the locking groove at a second edge of the first panel.

8. The set of building panels as claimed in claim 1, wherein the lower second element is attached to the first element with a tongue and groove connection.

9. The set of building panels as claimed in claim 8, wherein the tongue and groove attaching the lower second element to the upper first element are fixed to each other with glue.

10. The set of building panels as claimed in claim 1, wherein the locking strip is formed out of the lower second element.

11. The set of building panels as claimed in claim 10, wherein the locking element also is formed out of the lower second element.

12. The set of building panels as claimed in claim 1, wherein the upper first element is of oak and the lower second element is of beech or birch.

13. The set of building panels as claimed in claim 1, wherein each building panel comprises several lower second elements, arranged in a direction parallel to the first and second edges.

14. The set of building panels as claimed in claim 1, wherein the higher moisture shrinkage value of the lower second element is about 0.2 to 5 percent higher than that of the upper first element.

15. The set of building panels as claimed in claim 1, wherein the higher moisture shrinkage value of the lower second element is about 0.5 to 2 percent higher than that of the upper first element.

16. The set of building panels as claimed in claim 1, wherein the higher moisture shrinkage value of the lower second element is about 1 percent higher than that of the upper first element.

17. The set of building panels as claimed in claim 1, wherein the upper first element has radially oriented annual rings and the lower second element has tangentially oriented annual rings.

18. The set of building panels as claimed in claim 1, wherein the upper first element has tangentially oriented annual rings and the lower second element has tangential annual rings that are arranged in a direction opposite to a direction of the tangential annual rings of the upper first element.

19. A set of building panels, each building panel comprising an upper first element of solid wood fixed to a lower second element of solid wood, the upper first element and the lower second element are of different wood species, the building panels provided with a mechanical locking system which comprises a locking strip at a first edge of a first building panel, the locking strip provided with a locking element configured to cooperate with a locking groove at a second edge of a second building panel for horizontal locking of the first and second building panels when a tension force is applied to the first and second building panels, wherein a fibre direction of the upper first element and the lower second element is essentially along the first and the second edges, a toughness of the lower second element is higher than a toughness of the upper first element, and the locking strip comprises material of the second element.

20. The set of building panels as claimed in claim 19, wherein the upper first element is of a hard wood specie, and the lower second element is of a wood specie with higher toughness.

21. A set of building panels, each building panel comprising an upper first element of solid wood fixed to a lower second element of solid wood, the upper first element and the lower second element being of different wood species, and the lower second element being a single unitary piece of wood, the building panels provided with a mechanical locking system which comprises a locking strip at a first edge of a first building panel, the locking strip provided with a locking element configured to cooperate with a locking groove at a second edge of a second building panel for horizontal locking of the first and second building panels when a tension force is applied to the first and second building panels, wherein a fibre direction of the upper first element and the lower second element is essentially along the first and the second edges, the lower second element having about the same or a higher moisture shrinkage value than the upper first element, and the locking strip comprises material of the lower second element.

* * * * *